US006387151B1

(12) United States Patent
Standaert

(10) Patent No.: US 6,387,151 B1
(45) Date of Patent: May 14, 2002

(54) PRE-ALLOYED POWDER AND ITS USE IN THE MANUFACTURE OF DIAMOND TOOLS

(75) Inventor: Roger Standaert, Olen (BE)

(73) Assignee: N.V. Union Miniere S.A., Brussels (BE)

( * ) Notice: Subject to any disclaimer, the term of this patent is extended or adjusted under 35 U.S.C. 154(b) by 0 days.

(21) Appl. No.: 09/091,149

(22) Filed: Nov. 13, 1998

(30) Foreign Application Priority Data

Dec. 8, 1995 (BE) ..... 9501014

(51) Int. Cl.[7] ..... B22F 3/00

(52) U.S. Cl. ..... 75/255; 75/246; 419/11; 419/23

(58) Field of Search ..... 75/255, 246; 419/11, 419/23

(56) References Cited

U.S. PATENT DOCUMENTS

| | | | | |
|---|---|---|---|---|
| 2,238,351 A | | 4/1941 | Van Der Pyl | |
| 2,410,512 A | | 11/1946 | Lindquist et al. | |
| 4,049,380 A | | 9/1977 | Yih et al. | |
| 4,231,762 A | | 11/1980 | Hara | |
| 5,283,031 A | * | 2/1994 | Ogasawara et al. | 419/58 |

FOREIGN PATENT DOCUMENTS

| | | |
|---|---|---|
| JP | 5337992 | 4/1978 |
| SU | 1689053 | 11/1991 |

OTHER PUBLICATIONS

Chemical Abstracts, vol. 108, No. 22, May 30, 1988, Columbus, Ohio, US; Abstract No. 191222, Tsughiya, Shinjiro et al: "Copper–Iron Alloy Binder in Diamond Tools for Cutting and Polishing of fine Ceramics" XP002011548.
See abstract & JP 62 287 035 A (Fuji Die Co., Ltd., Japan).
Engström et al., "Powders and Processes for High Performance PM Steels", Powder Metallurgy, vol. 35, No. 1, 1992, pp. 67–72.

* cited by examiner

*Primary Examiner*—Daniel J. Jenkins
(74) *Attorney, Agent, or Firm*—Antonelli, Terry, Stout & Kraus, LLP

(57) ABSTRACT

A powder for sintering to manufacture a diamond tool has an average particle size of less than 8 $\mu$m and a loss of mass by reduction in hydrogen of less than 3% and contains 10–80% Fe, up to 40% Co, up to 60% Ni and up to 15% M. M is present, at least partially, in the oxidized state and representing one or more of the elements Mn, Cr, V., Al, Mo and Ti, the balance being unavoidable impurities. This powder may be sintered at 650–1000° C. to give a matrix having a high hardness.

12 Claims, 1 Drawing Sheet

PRE-ALLOYED POWDER AND ITS USE IN THE MANUFACTURE OF DIAMOND TOOLS

FIELD OF THE INVENTION

The present invention relates to the use of a pre-alloyed powder containing iron as binder in the manufacture of diamond tools by hot sintering.

BACKGROUND OF THE RELATED ART

In the manufacture of diamond tools by hot sintering, with or without pressure, of an intimate mixture of diamond and of binder, use is made, for the binder, that is to say the material forming the matrix of the tool at the end of the sintering operation, either of fine cobalt powders (1–6 μm) or of mixtures of fine powders, such as a mixture of fine cobalt, nickel and iron powders, or coarse pre-alloyed powders (less than 44 μm), such as a steel powder obtained by atomization.

The use of a fine cobalt powder has very good results from a technical standpoint; its only drawback stems from the high price of the powder.

Using mixtures of fine powders, matrices are obtained whose hardness and, consequently, the wear resistance, are relatively low.

The use of coarse pre-alloyed powders requires a sintering temperature of about 1100–1300° C., at which temperature degradation of the diamond, called graphitization, becomes appreciable.

SUMMARY OF THE INVENTION

Figure 1:
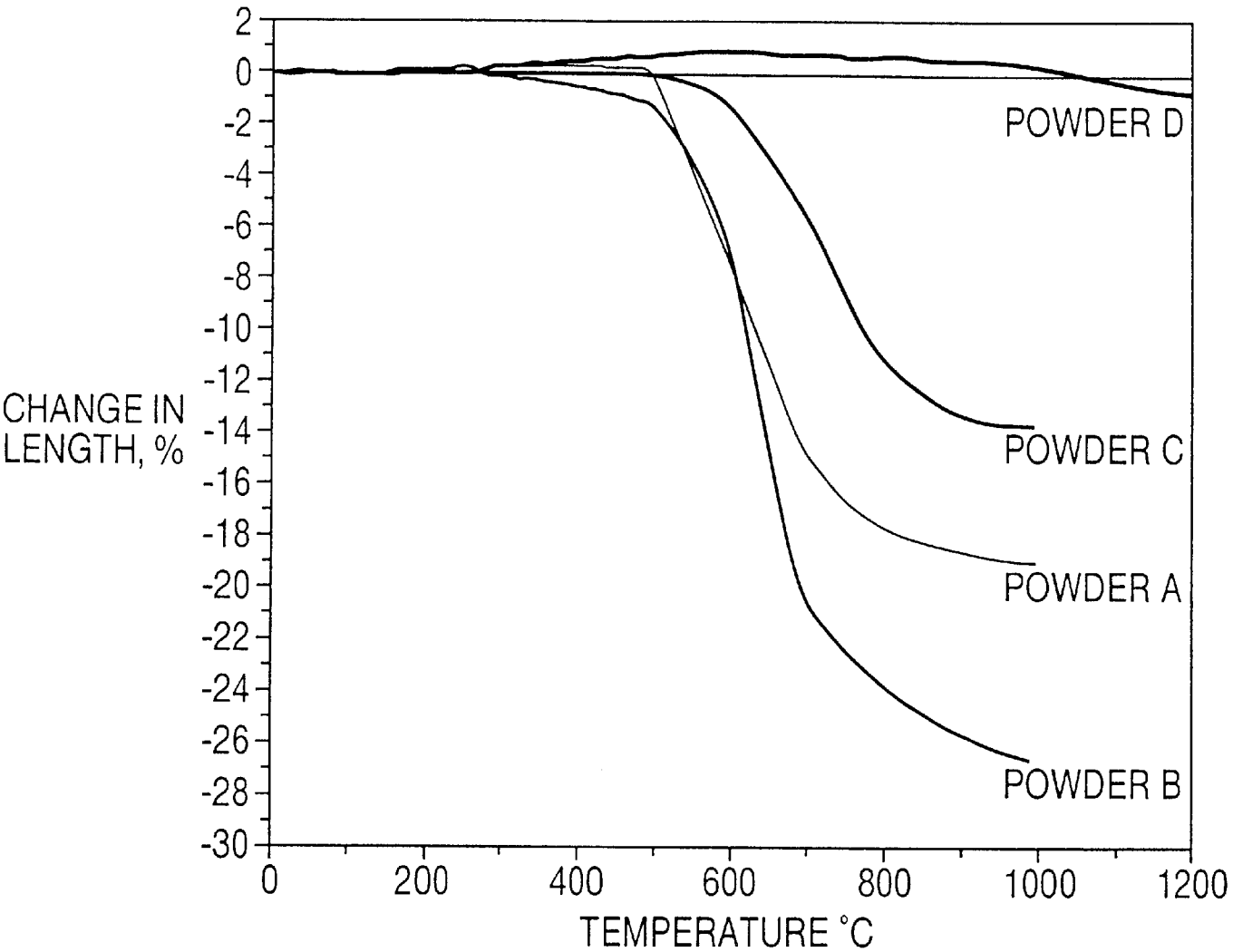
FIG. 1 is graphical plot relating % change in length to temperature, for disclosed powders.

A principle of the present invention is to provide a pre-alloyed powder containing iron, whose use as binder in the manufacture of diamond tools by hot sintering avoids the aforementioned drawbacks.

DETAILED DESCRIPTION OF THE PREFERRED EMBODIMENTS

For this purpose, the powder used according to the invention has an average particle size of less than 8 μm as measured with the Fisher Sub Sieve Sizer and a loss of mass by reduction in hydrogen of less than 3% as measured according to the standard ISO 4491–2:1989; this powder contains, in % by weight, 10–80% of iron, up to 40% of cobalt, up to 60% of nickel and up to 15% of M, M being present, at least partially, in the oxidized state and representing one or more of the elements Mn, Cr, V, Al, Mo and Ti, the other components in the powder consisting of unavoidable impurities.

In fact, it has been found that such a powder, which therefore Contains at most only 40% of cobalt, may be sintered at moderate temperatures (650–1000° C.) to give a matrix having a high hardness and that, furthermore, this hardness may be easily adapted to the particular requirements of the users of diamond tools, by varying the composition of the powder.

It is necessary for the particle size to be less than 8 μm in order that the powder be sinterable at moderate temperatures; advantageously, it is less than 5 μm. The loss of mass by reduction in hydrogen must be less than 3%; otherwise, there is a risk of producing, when the powder mixed with diamonds is sintered in a reducing atmosphere, such a great evolution of gas that porosity appears in the sintered product and/or that the graphitization of the diamond becomes too great; the said loss of mass is preferably less than 2%.

The abovementioned Fe, Co, Ni and M contents are necessary in order that the matrix have a suitable hardness and in order that this hardness be able to be adapted to the requirements of the users of diamond tools. Preference is given to an Fe content of at least 30%, a Co content ranging up to 30%, an Ni content of 10–30% and an M content ranging up to 10%, these contents leading to very high hardnesses. The most preferred Fe content is at least 50% and that of M equal to or less than 5%.

The present invention also relates to the above-defined pre-alloyed powder containing iron, this powder therefore being characterized in that it has an average particle size of less than 8 μm as measured with the Fisher Sub Sieve Sizer and a loss of mass by reduction in hydrogen of less than 3% as measured according to the standard ISO 4491–2:1989 and in that it contains, in % by weight, 10–80% of iron, up to 40% of cobalt, up to 60% of nickel and up to 15% of M, M being present, at least partially, in the oxidized state and representing one or more of the elements Mn, Cr, V, Al, Mo and Ti, the other components in the powder consisting of unavoidable impurities.

The powder of the invention may be prepared by heating, in a reducing atmosphere, a hydroxide, oxide, carbonate, basic carbonate (mixture of hydroxide and carbonate) or mixed organic salt of the constituents of the alloy so as to obtain a pulverulent product, whose loss of mass by reduction in hydrogen is less than 3%, and by comminuting this product (the expression "constituents of the alloy" is used here to denote all the elements present in the composition of the alloy, apart from oxygen: thus, for example, Fe, Ni, Co and Mn must be regarded as constituents of the Fe-Ni-Co-M-O alloy).

The hydroxide, carbonate, basic carbonate and the organic salt may be prepared by adding an aqueous solution of the constituents of the alloy to an aqueous solution of, respectively, a base, a carbonate, a base and a carbonate, and a carboxylic acid, separating the precipitate thus obtained from the aqueous phase and by drying the precipitate.

The solution of the constituents of the alloy may be a chloride solution, a sulphate solution, a nitrate solution or a mixed solution of these salts.

It may be useful to add a small quantity of carbon, for example 0.05–3%, in the form of an organic compound, to the pre-alloyed powder in order to reduce the risk of graphitization, this risk albeit low at the moderate temperatures used for the sintering.

EXAMPLE 1

This example relates to the preparation of a powder according to the invention by the precipitation of a mixed oxalate and the subsequent decomposition of this oxalate.

2.47 litres of a chloride solution containing 39 g/l of Co, 25 g/l of Ni, 85 g/l of Fe and 11 g/l of Mn are added at room temperature and with stirring, to 13.64 litres of an aqueous solution of oxalic acid containing 65 g/l of $C_2H_2O_4.2H_2O$. Thus, 94% of the Co, 85% of the Ni, 81% of the Fe and 48% of the Mn are precipitated in the form of a mixed oxalate. This precipitate is separated by filtration, washed in water and dried at 100° C. The dry precipitate contains 9.2% Co, 5.3% Ni, 17.2% Fe and 1.3% Mn.

The precipitate is heated at 520° C. in a stream of hydrogen for 6 hours. A pulverulent metallic product is thus obtained. Grinding this product in a mortar gives a pre-alloyed powder having a loss of mass by reduction in hydrogen of 2% and containing 27.1% Co, 15.7% Ni, 50.8% Fe and 3.9% Mn, and the particles of which have an average diameter of 2.1 μm, measured with the Fisher Sub Sieve Sizer. Examination of the powder using X-ray diffraction shows that virtually all of the Mn is present in the oxidized state.

EXAMPLE 2

This example relates to the preparation of a powder according to the invention by the precipitation of a mixed hydroxide and the subsequent reduction of this hydroxide.

9.4 litres of a chloride solution containing 24.4 g/l Co, 13.5 g/l Ni, 58.6 g/l Fe and 2.3 g/l Mn are added, at 80° C. and with stirring, to 36.7 litres of an aqueous solution of caustic soda containing 45 g/l of NaOH. Virtually all of these elements are thus precipitated in the form of a mixed hydroxide. This precipitate is separated by filtration, washed in water, repulped at 80° C. in a 45 g/l NaOH solution, separated once again by filtration, washed in water and dried at 100° C. The dry precipitate contains 14.8% Co, 8.2% Ni, 35.6% Fe and 1.4% Mn.

The precipitate is heated at 510° C. in a stream of hydrogen for 7.5 hours. The pulverulent metallic product thus obtained gives, after grinding in a mortar, a pre-alloyed powder having a loss of mass by reduction in hydrogen of 1.65% and containing 24.2% Co, 13.4% Ni, 58% Fe and 2.3% Me, and the particles of which have an average diameter of 2.1 Am. Examination of the powder using X-ray diffraction shows that virtually all the Mn is present in the oxidized state.

EXAMPLE 3

This example relates to a series of tests comparing the sinterability of two powders according to the invention, called hereinbelow powder A and powder B, of a fine Co powder (powder C) and of a Co powder obtained by atomization (powder D).

Powder A is that obtained according to Example 1 and powder B is that obtained according to Example 2. Powder C is a commercially available Co powder (1.5 μm) obtained via the oxalate route.

Powder D consists of particles having an average diameter of 9.7 μm.

A cylindrical pill, having a diameter of 4 mm and a length of 4 mm, of each of the powders to be tested is produced by cold pressing. These cylinders are heated at a rate of 5° C. per minute and the change in length as a function of temperature is measured. The variation of the change (in %) in the length of the cylinders as a function of temperature is given in the figure appended hereto.

The densities (in g/cm$^3$) of the cylinders before and after heating and the ratio between these densities are given in the table below:

| Powder | Density before heating (1) | Density after heating (2) | (1):(2) |
|---|---|---|---|
| A | 4.369 | 7.893 | 0.55 |
| B | 4.091 | 7.208 | 0.57 |

-continued

| Powder | Density before heating (1) | Density after heating (2) | (1):(2) |
|---|---|---|---|
| C | 5.459 | 8.591 | 0.64 |
| D | 6.974 | 7.972 | 0.87 |

These results show that the sinterability of the powders according to the invention (A and B ) is superior to that of the fine Co powder (C) and far superior to that of the coarse powder D.

EXAMPLE 4

In this example, the mechanical properties of sintered pieces made from cobalt powder, nickel powder, iron powder, various mixtures of Co, Fe, Ni and M powders and various powders according to the invention are compared.

The following powders are used:

- extra-fine cobalt powder from Union Miniére, having an average diameter (Fisher) of 1.50 μm and having a loss of mass by reduction in hydrogen (LMRH) of 0.55%;
- ex-carbonyl nickel powder having a Fisher of 2.06 μm and having an LMRH of 0.35%;
- ex-carbonyl iron powder having a Fisher of 4.00 μm and having an LMRH of 0.23%;
- electrolytic manganese powder having a Fisher of 2.80 μm and having an LMRH of 0.23%,
- mixtures of powders, made from the above powders and the Co, Ni, Fe and Mn contents of which are given in Table I below;
- powders according to the invention, the composition of which is given in Table II below, when these are powders prepared via the oxalate route, and in Table III below, when these are powders prepared via the hydroxide route; these powders have a Fisher of 1.8–2.2 μm; their LMRH is less than 2.5%.

The powders were sintered by pressing for 3 minutes at 650, 700, 750, 800, 850 or 900° C. under a pressure of 35 MPa in a graphite mould.

The density and the Vickers hardness of all the sintered pieces were measured. A large number of pieces were also subjected to the transverse bending test according to DIN/ISO 3325: the 45×10×6 mm sintered bar is placed so as to bear freely on two supports separated by 25 mm and the load is applied in the middle of this separation by means of a punch until the piece fails. The results are given in Tables I, II and III below, the first table referring to the elemental powders (Co, Ni, Fe) and to the mixtures of powders, the second table to the ex-oxalate powers of the invention and the third table to the ex-hydroxide powders of the invention.

TABLE I

Properties of sintered pieces made from elemental powders and mixtures of powders

| Test | Composition (%) * | | | | Sintering temperature | Properties of the sintered pieces: Density | Vickers Hardness | Bending test: Failure load | Deflection |
|---|---|---|---|---|---|---|---|---|---|
| Nº | Co | Ni | Fe | Mn | ° C. | g/cm³ | (HV 10) | N/mm² | mm |
| 1 | 100 | 0 | 0 | 0 | 750 | 8.503 | 237 | 1335 | 0.98 |
| 2 | 0 | 100 | 0 | 0 | 750 | 8.098 | 103 | 805 | 3.12 |
| 3 | 0 | 0 | 100 | 0 | 750 | 7.201 | 108 | 740 | 2.05 |
| 4 | 50 | 0 | 50 | 0 | 750 | 7.338 | 163 | 795 | 0.73 |
| 5 | 45 | 40 | 15 | 0 | 750 | 7.580 | 110 | 710 | 1.30 |
| 6 | 40 | 20 | 40 | 0 | 750 | 7.438 | 147 | 870 | 1.05 |
| 7 | 40 | 20 | 40 | 0 | 750 | 7.589 | 170 | 960 | 1.17 |
| 8 | 40 | 20 | 40 | 0 | 750 | 7.558 | 169 | 065 | 1.22 |
| 9 | 40 | 10 | 50 | 0 | 750 | 7.305 | 169 | 700 | 0.58 |
| 10 | 40 | 10 | 50 | 0 | 750 | 7.629 | 173 | 1080 | 1.16 |
| 11 | 40 | 10 | 50 | 0 | 850 | 7.724 | 231 | 770 | 0.56 |
| 12 | 35 | 30 | 35 | 0 | 750 | 7.349 | 117 | 775 | 1.04 |
| 13 | 30 | 10 | 60 | 0 | 750 | 7.337 | 158 | 1130 | 1.58 |
| 14 | 30 | 10 | 60 | 0 | 750 | 7.483 | 166 | 1245 | 1.79 |
| 15 | 30 | 10 | 60 | 0 | 850 | 7.557 | 183 | 1510 | 2.25 |
| 16 | 30 | 0 | 70 | 0 | 750 | 7.297 | 130 | 910 | 1.40 |
| 17 | 25 | 40 | 35 | 0 | 750 | 7.307 | 104 | 765 | 1.25 |
| 18 | 25 | 20 | 55 | 0 | 750 | 7.340 | 155 | 1125 | 0.90 |
| 19 | 25 | 20 | 55 | 0 | 750 | 7.434 | 165 | 1045 | 1.26 |
| 20 | 25 | 20 | 55 | 0 | 850 | 7.375 | 166 | 1275 | 1.53 |
| 21 | 25 | 10 | 65 | 0 | 750 | 7.462 | 155 | 1120 | 1.60 |
| 22 | 20 | 25 | 55 | 0 | 750 | 7.290 | 147 | 1035 | 1.35 |
| 23 | 20 | 25 | 55 | 0 | 750 | 7.297 | 153 | 1080 | 1.36 |
| 24 | 20 | 25 | 55 | 0 | 850 | 7.251 | 155 | 955 | 1.03 |
| 25 | 20 | 10 | 70 | 0 | 750 | 7.363 | 148 | 1050 | 1.54 |
| 26 | 20 | 0 | 80 | 0 | 750 | 7.147 | 114 | 885 | 1.60 |
| 27 | 15 | 30 | 35 | 0 | 750 | 7.355 | 140 | 1080 | 1.43 |
| 28 | 15 | 15 | 70 | 0 | 750 | 7.352 | 141 | 1010 | 1.33 |
| 29 | 10 | 50 | 40 | 0 | 750 | 7.053 | 92 | 750 | 1.32 |
| 30 | 10 | 0 | 90 | 0 | 750 | 7.250 | 112 | 865 | 2.12 |
| 31 | 0 | 50 | 45 | 5 | 750 | 7.110 | 129 | 850 | 1.11 |
| 32 | 0 | 50 | 45 | 5 | 750 | 7.190 | 133 | 870 | 1.00 |
| 33 | 0 | 50 | 45 | 5 | 850 | 7.501 | 151 | 1115 | 2.15 |
| 34 | 0 | 50 | 50 | 0 | 750 | 7.170 | 99 | 740 | 1.40 |
| 35 | 0 | 40 | 60 | 0 | 750 | 7.094 | 101 | 760 | 1.30 |
| 36 | 0 | 35 | 60 | 5 | 750 | 7.112 | 143 | 865 | 1.03 |
| 37 | 0 | 35 | 60 | 5 | 750 | 7.181 | 161 | 1245 | 1.00 |
| 38 | 0 | 35 | 60 | 5 | 850 | 7.513 | 160 | 1190 | 1.80 |
| 39 | 0 | 20 | 80 | 0 | 750 | 7.313 | 116 | 930 | 1.80 |
| 40 | 0 | 10 | 90 | 0 | 750 | 7.166 | 105 | 805 | 2.08 |

* the total of the elements Co, Ni, Fe and Mn being regarded as 100%.

TABLE II

Properties of sintered pieces obtained from powders of the invention:oxalate root

| Test | Composition (%) * | | | | Sintering temperature | Properties of the sintered pieces: Density | Vickers Hardness | Bending test: Failure load | Deflection |
|---|---|---|---|---|---|---|---|---|---|
| Nº | Co | Ni | Fe | Mn | ° C. | g/cm³ | (HV 10) | N/mm² | mm |
| 41 | 37.7 | 0 | 57.3 | 5 | 750 | 7.589 | 415 | | |
| 42 | 37.7 | 0 | 57.3 | 5 | 800 | 7.567 | 405 | 1212 | 0.48 |
| 43 | 37.7 | 0 | 57.3 | 5 | 850 | 7.676 | 390 | | |
| 44 | 33.4 | 0 | 59 | 7.6 | 750 | 7.676 | 435 | | |
| 45 | 33.4 | 0 | 59 | 7.6 | 800 | 7.541 | 400 | 1041 | 0.43 |
| 46 | 33.4 | 0 | 59 | 7.6 | 850 | 7.634 | 385 | | |
| 47 | 33.3 | 9.5 | 57.2 | 0 | 750 | 8.076 | 425 | | |
| 48 | 33.3 | 9.5 | 57.2 | 0 | 800 | 8.006 | 395 | 1893 | 0.70 |
| 49 | 33.3 | 9.5 | 57.2 | 0 | 850 | 8.034 | 400 | | |
| 50 | 33.1 | 29.5 | 32.4 | 5 | 750 | 8.090 | 330 | | |
| 51 | 33.1 | 29.5 | 32.4 | 5 | 850 | 8.115 | 295 | | |
| 52 | 29.3 | 0 | 60 | 10.7 | 750 | 7.318 | 485 | | |

TABLE II-continued

| Properties of sintered pieces obtained from powders of the invention:oxalate root | | | | | | | | | |
|---|---|---|---|---|---|---|---|---|---|
| | | | | | | Properties of the sintered pieces | | | |
| | | | | | Sintering | | Vickers | Bending test | |
| Test | Composition (%) * | | | | temperature | Density | Hardness | Failure load | Deflection |
| N° | Co | Ni | Fe | Mn | ° C. | g/cm³ | (HV 10) | N/mm² | mm |
| 53 | 29.3 | 0 | 60 | 10.7 | 800 | 7.316 | 440 | 896 | 0.40 |
| 54 | 29.3 | 0 | 60 | 10.7 | 850 | 7.435 | 395 | | |
| 55 | 28.4 | 13.6 | 50.4 | 7.6 | 750 | 7.719 | 478 | | |
| 56 | 28.4 | 13.6 | 50.4 | 7.6 | 850 | 7.768 | 439 | | |
| 57 | 28.4 | 10.9 | 60.7 | 0 | 750 | 7.844 | 430 | 1320 | 0.69 |
| 58 | 28.4 | 10.9 | 60.7 | 0 | 750 | 7.778 | 445 | | |
| 59 | 28.4 | 10.9 | 60.7 | 0 | 850 | 7.946 | 392 | 1615 | 0.83 |
| 60 | 28.4 | 10.9 | 60.7 | 0 | 850 | 7.919 | 421 | | |
| 61 | 27.8 | 16.1 | 52.1 | 4 | 750 | 7.839 | 470 | | |
| 62 | 27.8 | 16.1 | 52.1 | 4 | 800 | 7.779 | 495 | 1928 | 0.85 |
| 63 | 27.8 | 16.1 | 52.1 | 4 | 850 | 7.831 | 345 | | |
| 64 | 27.1 | 12.6 | 54.3 | 6 | 750 | 7.632 | 550 | | |
| 65 | 27.1 | 12.6 | 54.3 | 6 | 800 | 7.568 | 470 | 1117 | 0.50 |
| 66 | 27.1 | 12.6 | 54.3 | 6 | 850 | 7.638 | 440 | | |
| 67 | 22.5 | 13.7 | 57.1 | 6.7 | 750 | 7.636 | 430 | | |
| 68 | 22.5 | 13.7 | 57.1 | 6.7 | 850 | 7.662 | 473 | | |
| 69 | 18 | 24.2 | 52.4 | 5.4 | 750 | 7.883 | 238 | | |
| 70 | 18 | 24.2 | 52.4 | 5.4 | 850 | 7.805 | 271 | | |
| 71 | 0 | 56.5 | 41 | 2.5 | 750 | 8.367 | 307 | | |
| 72 | 0 | 56.5 | 41 | 2.5 | 850 | 8.655 | 299 | | |
| 73 | 0 | 53.3 | 41.1 | 5.6 | 750 | 8.470 | 347 | | |
| 74 | 0 | 53.3 | 41.1 | 5.6 | 850 | 8.235 | 309 | | |
| 75 | 0 | 34.1 | 60.4 | 5.5 | 750 | 7.824 | 238 | | |
| 76 | 0 | 34.1 | 60.4 | 5.5 | 850 | 7.879 | 235 | | |
| 77 | 0 | 33.3 | 60.1 | 6.6 | 750 | 7.806 | 270 | | |
| 78 | 0 | 33.3 | 60.1 | 6.6 | 800 | 7.624 | 260 | 980 | 0.55 |
| 79 | 0 | 33.3 | 60.1 | 6.6 | 850 | 7.758 | 240 | | |

* the total of the elements Co, Ni, Fe and Mn being regarded as 100%.

TABLE III

| Properties of sintered pieces obtained from powders of the invention:hydroxide route | | | | | | | |
|---|---|---|---|---|---|---|---|
| | | | | | | Properties of the sintered pieces | |
| Test | Composition (%)* | | | | Sintering temperature | Density | Vickers Hardness |
| N° | Co | Ni | Fe | Mn | ° C. | g/cm³ | (HV 10) |
| 80 | 24.7 | 13.7 | 59.3 | 2.3 | 650 | 7.848 | 401 |
| | | | | | 700 | 7.853 | 439 |
| | | | | | 750 | 7.704 | 401 |
| | | | | | 800 | 7.719 | 381 |
| | | | | | 850 | 7.736 | 368 |
| | | | | | 900 | 7.708 | 367 |
| 81 | 25.8 | 13.4 | 58.5 | 2.3 | 750 | 7.763 | 412 |
| 82 | 35.3 | 10.4 | 54.2 | 0.1 | 650 | 7.952 | 462 |
| | | | | | 700 | 7.969 | 421 |
| | | | | | 750 | 7.393 | 420 |
| | | | | | 800 | 7.904 | 420 |
| | | | | | 850 | 7.964 | 400 |
| | | | | | 900 | 7.904 | 386 |
| 83 | 32.9 | 11.5 | 55.0 | 0.6 | 650 | 8.034 | 473 |
| | | | | | 700 | 7.871 | 425 |
| | | | | | 750 | 8.170 | 420 |
| | | | | | 800 | 7.931 | 425 |
| | | | | | 850 | 8.013 | 417 |
| | | | | | 900 | 7.906 | 414 |

*the total of the elements Co, Ni, Fe and Mn being regarded as 100%.

These results show that, after sintering, superior mechanical properties are obtained with the pre-alloyed powders according to the invention than with mixtures of elemental powders. For comparable compositions (see, for example, test No. 14 versus test No, 57), the hardness obtained with the powders of the invention is from 2 to 3 times higher than that obtained with mixtures of powders. With regard to the failure load, higher values were measured with the pre-alloyed powders than with the mixed powders within the 25–35% Co, 5–20% Ni and 45–55% Fe range; outside this range, the failure loads are comparable.

EXAMPLE 5

This example relates to the use of a powder according to the invention in the manufacture of diamond tools.

Powder obtained in Example 1 is mixed with It of synthetic diamonds. The mixture is sintered by pressing under vacuum at 800° C. and 35 MPa.

Microscope examination of the sintered material shows that the manganese oxide is finely dispersed in the metallic matrix, that the diamonds remain intact and that they are firmly embedded in the metallic matrix.

Obvious modifications and variations of the above-described structure and the manner of its use will no doubt occur to persons of ordinary skill in the art. All such obvious modifications and variations are intended to be comprehended within the present invention which is limited solely by the claims appended below.

What is claimed is:

1. In a method of manufacturing diamond tools comprising hot sintering a mixture of diamonds and a binder material, the improvement comprising using a pre-alloyed powder as a binder material, wherein the powder has an average particle size of less than 8 μm as measured with the Fisher Sub Sieve Sizer and a loss of mass by reduction in hydrogen of less than 3% as measured according to the standard ISO 4491–2:1989, and the powder contains, in % by weight, 10–80% of iron, up to 40% of cobalt, up to 60% of nickel and up to 15% of M, wherein M is present, at least partially, in an oxidized state and represents one or more of the elements Mn, Cr, V, Al, Mo and Ti, the other components in the powder consisting of unavoidable impurities.

2. The method according to claim 1, wherein the powder has an average particle size of less than 5 μm.

3. The method according to claim 1, wherein the powder contains at least 50% of iron.

4. The method according to claim 1, wherein the powder contains up to 30% of Co.

5. The method according to claim 1, wherein the powder contains 10–30% of Ni.

6. The method according to claim 1, wherein the powder contains up to 10% of M.

7. The method according to claim 1, wherein said loss of mass is less than 2%.

8. The method according to claim 1, wherein the powder is prepared by heating, in a reducing atmosphere, one of a mixed hydroxide or a mixed oxalate of the corresponding element.

9. The method according to claim 8, wherein 0.05–3% of carbon in the form of an organic compound is added to the powder.

10. The method according to claim 1, wherein the sintering is carried out at a temperature in the range 650–1000° C.

11. A method of manufacturing a diamond tool, comprising:

hot sintering a mixture of diamonds and a powder comprising iron as a binder, wherein the powder has an average particle size of less than 8 μm as measured with the Fisher Sub Sieve Sizer and a loss of mass by reduction in hydrogen of less than 3% as measured according to the standard ISO 4491–2:1989, and the powder contains, in % by weight, 10–80% of iron, up to 40% of cobalt, up to 60% of nickel and up to 15% of M, wherein M is present, at least partially, in an oxidized state and represents one or more of the elements Mn, Cr, V, Al, Mo and Ti, the other components in the powder consisting of unavoidable impurities.

12. A pre-alloyed powder composition for sintering, comprising:

iron to serve as a binder, wherein the powder has an average particle size of less than 8 μm as measured with the Fisher Sub Sieve Sizer and a loss of mass by reduction in hydrogen of less than 3% as measured according to the standard ISO 4491–2:1989, and the powder contains, in % by weight, 10–80% of iron, with the balance including up to 40% of cobalt, up to 60% of nickel and up to 15% of M, wherein M is present, at least partially, in an oxidized state and represents one or more of the elements Mn, Cr, V, Al, Mo and Ti, and unavoidable impurities.

* * * * *